US005590446A

United States Patent [19]

Hicks

[11] Patent Number: 5,590,446

[45] Date of Patent: Jan. 7, 1997

[54] DOUBLE DEPTH CRYPT

[75] Inventor: Daniel J. Hicks, Ft. Lauderdale, Fla.

[73] Assignee: Carlton Wilbert Vaults, Inc., Miami, Fla.

[21] Appl. No.: 525,272

[22] Filed: Sep. 8, 1995

[51] Int. Cl.[6] ..... A61G 17/00

[52] U.S. Cl. ..... 27/1; 27/26; 52/136; 52/137

[58] Field of Search ..... 27/1, 26–30; 52/128, 52/133, 134, 136, 137, 138, 139, 140–141

[56] References Cited

U.S. PATENT DOCUMENTS

| | | | |
|---|---|---|---|
| 908,305 | 12/1908 | Moore | 52/137 |
| 951,493 | 3/1910 | Renshaw | 52/137 |
| 1,030,385 | 6/1912 | Clarkson | 52/137 |
| 2,265,876 | 12/1941 | Sleichter | 52/135 |
| 2,289,435 | 7/1942 | Kirby | 52/135 |
| 2,822,685 | 2/1958 | Chandler et al. | 52/137 |
| 2,913,895 | 11/1959 | Blasius et al. | 52/137 |
| 3,230,674 | 1/1966 | Christensen | 52/137 X |
| 3,772,826 | 11/1973 | Ferver | 52/124.2 X |
| 3,778,941 | 12/1973 | Dorris | 52/134 X |
| 5,076,151 | 12/1991 | Carrier | 52/134 X |

OTHER PUBLICATIONS

"When Lawn Crypts Are A Consideration . . . Choose Carlton" by Carlton Wilbert Vaults, Inc., cited prior art.

*Primary Examiner*—Carl D. Friedman
*Assistant Examiner*—Beth Aubrey
*Attorney, Agent, or Firm*—Westman, Champlin & Kelly, P.A.

[57] ABSTRACT

The double depth crypt which permits having two crypt compartments completely independent from each other. The double depth crypt including a lower crypt compartment having an upper edge, and an upper crypt compartment that has a lower cover portion configured to mate with and seal on the upper edge of the lower crypt compartment. The upper crypt compartment also has an upper edge on which a separate cover is placed. The upper crypt compartment and the cover portion can be formed using a standard cover adhered to the lower portion of a crypt housing, or can be integrally molded as a unit.

6 Claims, 3 Drawing Sheets

DOUBLE DEPTH CRYPT

BACKGROUND OF THE INVENTION

The present invention relates to an inground crypt having two vertically spaced crypt compartments for two vertically stacked caskets, separately encrypted and sealed and arranged for permitting separate interments in each of the compartments, and to a method of making the crypt.

At the present time, it is becoming more and more common for cemetery administrators to use double depth lawn crypts, so that burial of two caskets in a single opening is possible. This provides greater utilization of land, and minimum ground opening and closing expense. It is desirable to have separate enclosed concrete crypts for each casket, for insuring that a second burial in the same grave opening will not disturb the casket of the first burial. Each casket is within a separate sealed compartment.

Presently, concrete crypts are known, and they usually will provide casket rests at two different levels within a single housing of concrete, and with a single sealable cover.

If two interments are made at differing times the crypt has to be opened, exposing the first casket when the second casket is being put into place.

SUMMARY OF THE INVENTION

The present invention relates to a double depth double compartment crypt compartment that permits individually closing and sealing the lower crypt compartment while providing an upper crypt that is available for subsequent interment, without disturbing the lower casket.

The present invention provides a fully sealed crypt or enclosure for the lower casket, while the upper crypt remains in place and individually openable. When the upper crypt is to be utilized for an interment the only need is to open the top portion of a grave and remove the cover from the upper crypt for interment of the casket, after which the cover can then again be resealed.

The present invention insures that the first interment in the lower compartment of the double depth crypt is not disturbed, when the second interment takes place and permitting the lower compartment to be completely sealed irrespective of a subsequent interment in the upper crypt.

DETAILED DESCRIPTION OF THE PREFERRED EMBODIMENTS

Figure 1:
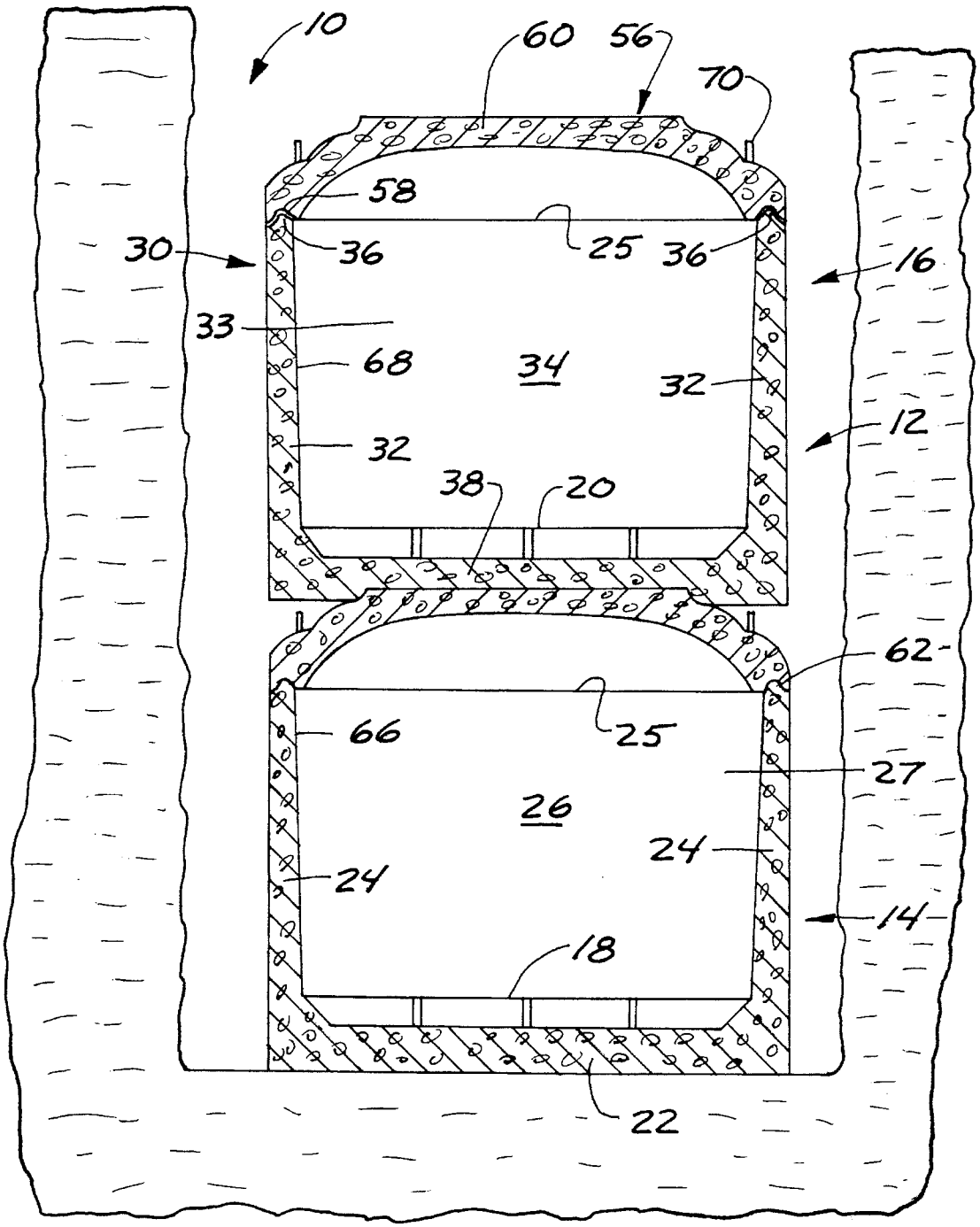
FIG. 1 is a vertical cross sectional view of a double depth crypt made according to the present invention shown in a single opening in the ground.

A grave opening 10 is shown in FIG. 1 and is of sufficient depth to receive a double depth concrete crypt 12 made according to the present invention.

The crypt 12 includes a lower crypt compartment 14 and an upper crypt compartment 16, both of which are elongated so that they will receive a casket on independent casket rests shown at 18 and 20, respectively.

Figure 2:
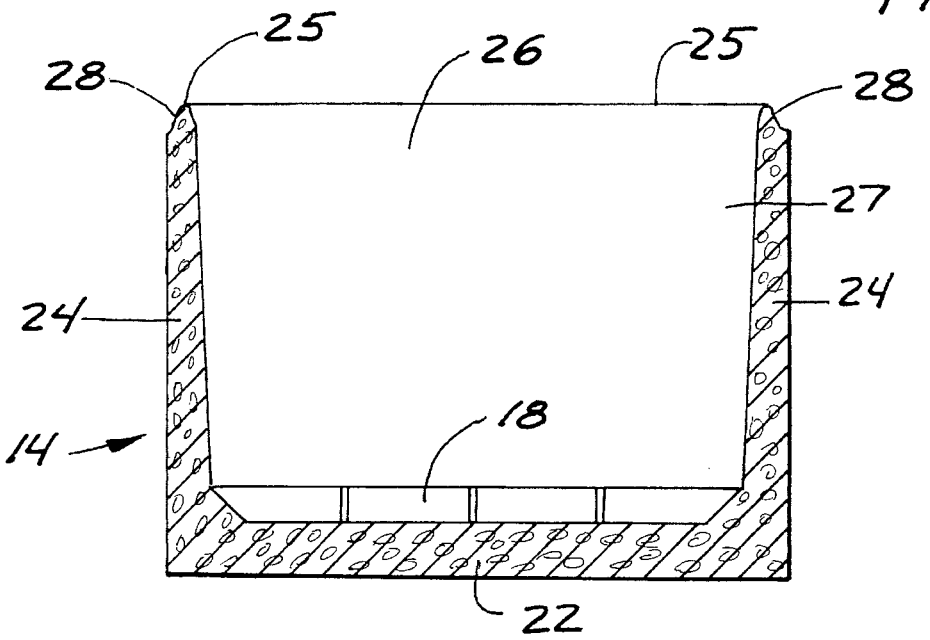
FIG. 2 is a cross sectional view of a typical concrete crypt used as the lower crypt, formed with a tongue formed at the upper edge for sealing with a cover.

The lower crypt compartment 14 is illustrated in FIG. 2, again in cross section, and it can be seen that it is a housing 21, that has a concrete base or bottom wall 22, upright reinforced concrete sidewalls 24, 24 and end walls 26 that join the sidewalls (only one end wall is shown). The crypt compartment housing 21 is generally rectangular, and the upper edges 25 of the walls 24 and 26 are provided with a tongue 28 formed around the perimeter. The tongue 28 will mate with a suitable groove in a cover that will seal the crypt compartment. The lower crypt compartment as shown is a standard size crypt presently available having an inner chamber 22 of size to receive a coffin, and presently used for interments in various locations. The crypt compartment 14 is rectangular and of size to receive and enclose a coffin.

Figure 3:
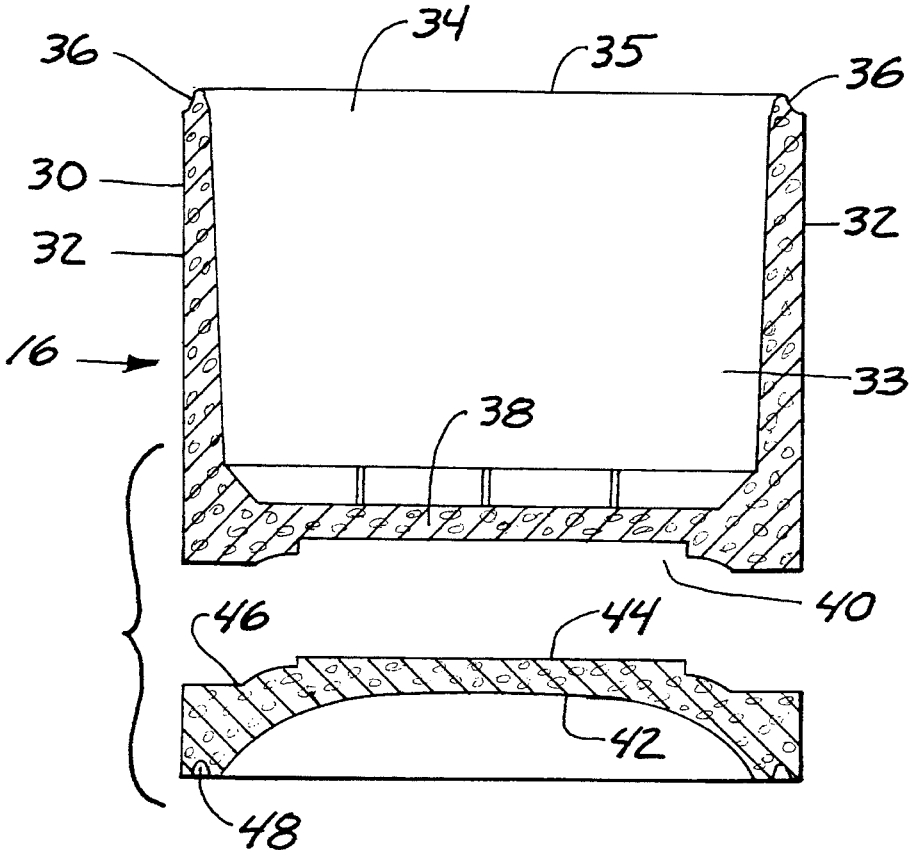
FIG. 3 is an exploded view of an upper crypt incorporating a cover for the lower crypt shown in FIG. 1.

The upper crypt compartment 16 is illustrated partially formed in FIG. 3. While the method of forming shown is a preferred method, in order to reduce molding costs, handling weight and the like, it is to be understood that the upper crypt compartment can be made as a unitary structure shown in FIG. 5 instead of a two-piece structure as shown in FIG. 3. The upper crypt compartment 16 as shown includes an upper crypt housing 30 that has sidewalls 32 made of concrete and end walls 34 (only one is shown) forming an inner chamber 33. The upper edges 35 of walls 32 and 34 have a tongue 36, configured the same as used on the lower crypt compartment 14. The bottom wall 38 of the upper crypt compartment has a socket or recess 40 formed in the bottom surface, of size to receive the upper portion of a crypt cover 42, also shown in FIG. 3. The crypt cover 42 is configured as a standard cover that fits on the top of the upper crypt housing 30, but it is made so that it has a top platform or boss 44 that will fit into the recess 40, and as will be explained it is cemented in place. The cover 42 is also made of reinforced concrete, and has downwardly facing side edges 46 with a peripheral groove 48 that is configured to receive the tongue 28 or the tongue 36, which are constructed identically.

Figure 4:
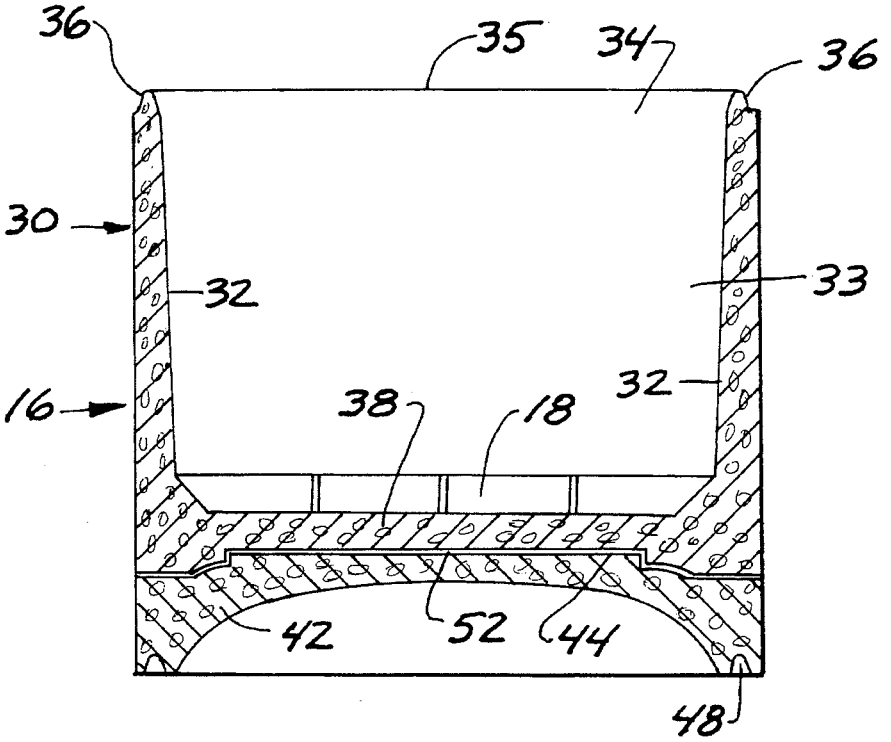
FIG. 4 is a view of the upper crypt and cover for the lower crypt after forming and prior to installation in the ground opening for sealing the lower crypt.

FIG. 4 shows the assembly of the upper crypt compartment 16. The cover for the lower crypt compartment can be cast in place, or if desired the bottom surface of the upper crypt 16 could be flat, and merely cemented with an adhesive to the platform 44 of the lower crypt compartment cover 42. In any event before the top platform of cover 42 is placed into the recess 40, a layer of adhesive or cement, or other structural material, is placed on the parts. The cover 42 is moved against the upper crypt housing 30 and the housing is permanently joined to the cover 42 to form a unitary assembly. Again, with suitable molds, what becomes a cover portion 42 of the other crypt can be integrally molded into place with housing 30 so that it is a unitary body.

Figure 5:
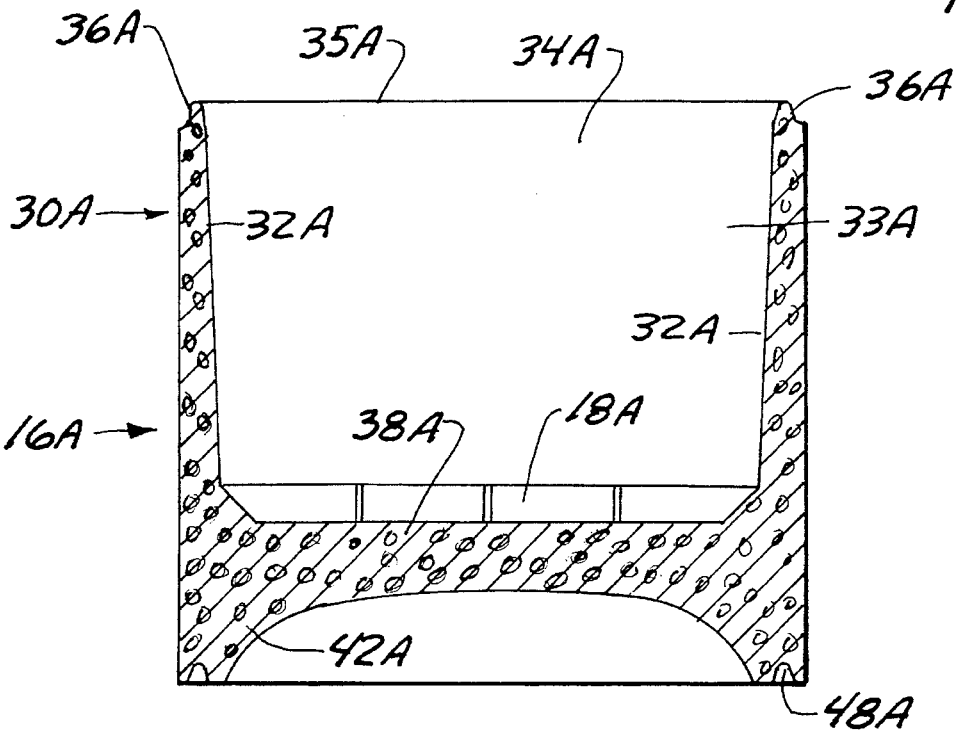
FIG. 5 is a view the same as FIG. 4 with the upper crypt compartment and cover portion integrally molded.

FIG. 5 illustrates a unitary cast upper crypt 16A. The numbers used are the same as in FIG. 4, followed by "A". The cover portion 42A is formed as part of the bottom wall 38A, but functions as explained in connection with the previous figures.

It can be seen now that the assembly of the upper crypt 16 is capable of being moved as a unit (housing and cover). The upper edge of upper crypt 16 receives a standard cover shown in FIG. 1. The standard cover has a peripheral groove 58 on its bottom surface, and a reinforced concrete cover portion 60. The groove 58 receives the tongue 36 of the upper crypt 16 to provide a seal. Lift attachments 70 are provided. The upper and lower crypts also have lift handles or lugs placed to permit chains or straps to be attached for mechanical lifting and lowering.

When interment is to take place, the opening 10 is made sufficiently deep so that it will accommodate a double depth crypt 12, made according to the present invention, and the lower crypt compartment 14 is lowered into place for receiving the first casket. The upper crypt 16 is not placed in the opening until a casket has been placed on a lower casket rest 18. Then, when interment of the first casket has been completed the upper crypt 16 is lowered into place after placing a suitable sealant in the groove 48 of the cover portion 42, as shown at 62. This sealant will completely seal the interior chamber 27 of the lower crypt compartment.

It also should be noted that the crypt, both the lower crypt chamber and the upper crypt chamber are lined with a water resistant, durable plastic lining shown by the heavy lines 66 in the lower crypt compartment and along the inner surface shown by heavy lines 68 in the upper crypt compartment as well as on the inner surface of cover portion 42 and on the inner surface of upper cover 60 to completely make the concrete structures water resistant. Then, when the upper crypt compartment is in place the lower crypt is completely sealed and water resistant.

The upper crypt compartment can remain empty, and the upper cover 60 merely placed on the upper crypt to keep debris from falling in. The opening 10 can be closed. The upper crypt compartment 16 can remain empty until such time an interment is to take place. The opening 10 merely needs to open to the extent that the cover 60 can be accessed and raised through suitable lift lugs or handles 70, and a second interment can take place without disturbing the seal 62 or in any way disturbing the casket in the lower crypt compartment 14.

In this manner, the second interment is made much more simple, and the upper crypt can be left to receive a second casket for any length of time desired. More than two crypts can be made in the same manner if desired.

The material can be any desired reinforced concrete, or other material needed in order to meet existing codes for burials.

Although the present invention has been described with reference to preferred embodiments, workers skilled in the art will recognize that changes may be made in form and detail without departing from the spirit and scope of the invention.

What is claimed is:

1. A crypt arrangement for providing an individually sealable double depth crypt for burying in the ground comprising:

a lower crypt compartment forming a housing of size to contain a first coffin and having an upper edge;

an upper crypt compartment forming a housing of size to contain a second coffin and having an upper edge, the upper crypt compartment having a lower wall and a cover portion mounted integrally on the lower wall of the compartment, said cover portion being of size to enclose the lower crypt compartment and having edges that interlockingly mate with the upper edge of the lower crypt compartment to form a sealed lower crypt compartment for the first coffin, the cover portion being arched and having downwardly extending edges formed to be spaced from the bottom wall of the upper crypt compartment along the cover portion edges and being joined to the bottom wall in center portions thereof, the interlocking upper edges of the lower crypt compartment and of the cover portion supporting the upper edges against inward pressures; and a separate cover independently moveable relative to the upper crypt compartment for enclosing the upper crypt compartment without moving the upper crypt compartment and cover portion relative to the lower crypt compartment.

2. The crypt of claim 1, and an internal sealing layer on inner surfaces of the lower crypt compartment and upper crypt compartment.

3. The crypt of claim 1, wherein the upper edges of the lower crypt compartment and the upper crypt compartment are formed to provide tongue members around the periphery of the respective compartments, and the separate cover, and the cover portion each having a groove for receiving the tongue portion of the upper crypt compartment and the lower crypt compartment, respectively.

4. The crypt of claim 1, wherein the upper crypt compartment is installable on the lower crypt compartment while permitting access to the upper crypt compartment without disturbing the lower crypt compartment.

5. A method of forming a double depth crypt comprising the steps of:

forming an individual lower crypt compartment having an upper edge and an inner chamber of size to receive a coffin;

forming an upper crypt compartment having a bottom wall and including a lower cover portion, said lower crypt compartment cover portion being of size to rest on the upper edge of the lower crypt compartment and enclose and seal the inner chamber of the lower crypt compartment; the step of forming of the upper crypt compartment including the steps of separately forming the upper compartment to have the bottom wall and separately forming the lower cover portion, and then attaching the separately formed lower cover portion to the bottom wall of the formed upper crypt compartment.

6. The method of claim 5 including the step of providing a second cover for sealingly enclosing the upper crypt compartment separately from the lower crypt compartment.

* * * * *